US007659863B2

(12) United States Patent
Kai et al.

(10) Patent No.: US 7,659,863 B2
(45) Date of Patent: Feb. 9, 2010

(54) TAG ANTENNA

(75) Inventors: Manabu Kai, Kawasaki (JP); Toru Maniwa, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/313,814

(22) Filed: Dec. 22, 2005

(65) Prior Publication Data

US 2006/0208955 A1 Sep. 21, 2006

(30) Foreign Application Priority Data

Mar. 17, 2005 (JP) ..... 2005-076492
Oct. 17, 2005 (JP) ..... 2005-302210

(51) Int. Cl.
*H01Q 9/28* (2006.01)

(52) U.S. Cl. ..... 343/795; 343/793

(58) Field of Classification Search ..... 343/795, 343/793, 860
See application file for complete search history.

(56) References Cited

U.S. PATENT DOCUMENTS 4,513,292 A * 4/1985 Bowman ..... 343/795
4,736,207 A 4/1988 Siikarla et al.
4,860,019 A 8/1989 Jiang et al.
5,793,305 A 8/1998 Turner et al.
6,147,662 A 11/2000 Grabau et al.
6,259,408 B1 7/2001 Brady et al.
6,265,977 B1 7/2001 Vega et al.
6,323,821 B1 11/2001 McLean
6,784,853 B2 8/2004 Ikramov et al.
6,894,624 B2 5/2005 Kim et al.
6,961,028 B2 * 11/2005 Joy et al. ..... 343/895
6,975,278 B2 * 12/2005 Song et al. ..... 343/795
6,999,028 B2 2/2006 Egbert (Continued)

FOREIGN PATENT DOCUMENTS

EP 1 703 447 A2 9/2006

(Continued)

OTHER PUBLICATIONS

"Antenna Engineering Handbook," The Institute of Electronics, Information and Communication Engineers, Ohmsha, Ltd., Oct. 30, 1980, pp. 112-115 w/cover page.

(Continued)

*Primary Examiner*—Trinh V Dinh
(74) *Attorney, Agent, or Firm*—Hanify & King, P.C.

(57) ABSTRACT

A dipole part of a length shorter than half of an antenna resonance wavelength is placed so as to be rolled and enables a feeding part 11 to feed a chip. An inductance part 12 for adjusting the inductance of the antenna is provided so as to sandwich the feeding part 11. The inductance 12 is provided using an empty space of the inside of the rolled dipole part. By providing the inductance part 12, the inductance of the antenna can be adjusted so as to resonate at a predetermined frequency with the capacitance of the chip connected to the feeding part 11. At this time, although the radiation resistance of the antenna becomes extremely large according to calculations, it is actually almost the same as the resistance of the chip due to loss, and the power received by the antenna can be provided to the chip.

5 Claims, 21 Drawing Sheets

U.S. PATENT DOCUMENTS

| | | | | |
|---|---|---|---|---|
| 7,182,994 | B1 * | 2/2007 | Scott | 428/131 |
| 2004/0130499 | A1 | 7/2004 | Weiss | |
| 2005/0024287 | A1 | 2/2005 | Jo et al. | |
| 2005/0070375 | A1 | 3/2005 | Savarese et al. | |
| 2006/0061515 | A1 * | 3/2006 | Posluszny et al. | 343/803 |
| 2006/0109192 | A1 * | 5/2006 | Weigand | 343/795 |
| 2006/0273976 | A1 * | 12/2006 | Wang et al. | 343/795 |

FOREIGN PATENT DOCUMENTS

| | | |
|---|---|---|
| JP | A 52-052549 | 4/1977 |
| JP | A 2005-327331 | 12/1993 |
| JP | A 2000-222540 | 8/2000 |
| JP | A 2003-242471 | 8/2003 |
| JP | 2003-271910 A | 9/2003 |
| JP | A 2003-309418 | 10/2003 |
| JP | A 2004-503125 | 1/2004 |
| JP | A 2004-505481 | 2/2004 |
| JP | 2004-104344 A | 4/2004 |
| JP | A 2004-295466 | 10/2004 |
| JP | A 2005-513845 | 5/2005 |
| JP | A 2004-054078 | 9/2005 |
| JP | A 2004-323850 | 5/2006 |
| JP | A 2006-528005 | 3/2007 |
| JP | A 2006-547106 | 6/2007 |
| WO | WO 03/052870 A1 | 6/2003 |

OTHER PUBLICATIONS

Wadell, B.C. "Transmission Line Design Handbook," Artech House, 1991, pp. 404-405.

Balanis, C.A. "Antenna Theory Analysis and Design Second Edition," John Wiley & Sons, Inc., May 29, 1996, pp. 17-21 w/cover page.

Office Action, Taiwanese Intellectual Property Bureau, Application No. 94145238; dated Mar. 10, 2008; with attached English translation; 4 pages.

European Patent Office Communication pursuant to Article 94(3) EPC; Reference No. P105215EP00; Application No. 05 258 004.0-2220; dated Jan. 23, 2008; 5 pages.

Japanese Official Action dated Oct. 14, 2008 in the corresponding Japanese Application No. JP2005-302210 with English Translation.

Decision to Refuse a European Patent Application and the Provision of the Minutes in Accordance with Rule 124(4) EPC dated May 20, 2009 for the corresponding European Patent Application No. 05 258 0040.0.

Notice of Grounds of Rejection for the corresponding Chinese Patent Application No. 2006100049422 dated Jun. 5, 2009.

Summons to Attend Oral Proceedings for EP Application 05258004.0-2220/1703589 dated Feb. 10, 2009.

Notice of Rejection Grounds for the corresponding Japanese Patent Application dated Mar. 17, 2009.

* cited by examiner

TAG ANTENNA

BACKGROUND OF THE INVENTION

1. Field of the Invention

The present invention is related to a non-contact tag antenna which communicates RFID reader/writer.

2. Description of the Related Arts

A system which enables a reader/writer to read information from a tag by transmitting a signal of approximately 1 W from the reader/writer, receiving this signal at the tag-end, and returning a response signal to the reader/writer, again, using the UHF band (860 to 960 MHz) radio signals, is called an RFID system. Although the communication distance thereof differs according to the tag antenna gain, chip operation voltage, and peripheral environment, it is about 3 m. A tag comprises an antenna with a thickness of 10 to 30 μm and an LSI chip which is connected to the antenna feed point.

FIGS. 1A to 1C are diagrams explaining the tag antenna used in a conventional RFID system. FIG. 2 is a diagram showing an equivalent circuit of an RFID tag antenna. FIG. 3 is a diagram showing an analysis example according to an admittance chart of a conventional tag antenna.

As shown in FIG. 2, the LSI chip can be equivalently represented by the parallel connection of resistance Rc (for example, 1200Ω) and capacitance Cc (for example, 0.7 pF) . This is shown in the position indicated by a circle in FIG. 3, in the admittance chart. On the other hand, the antenna can be equivalently represented by the parallel connection of resistance Rc (for example, 1000Ω) and inductance (for example, 40 nH). By parallel-connecting both LSI chip and antenna, the capacitance and inductance resonate, and as seen from the equation $f0=1/(2\pi\sqrt{(LC)})$, of the resonant frequency, the antenna and chip can be matched with the desired resonant frequency f0, and the reception power at the antenna is sufficiently supplied to the chip-end.

As a basic antenna used as a tag antenna, a dipole antenna of a total length of 145 mm, shown in FIG. 1A, is considered. In this antenna, a dipole part 10 is connected to a feeding part 11, electric power is extracted from a signal received by the dipole part 10, the feeding part feeds the chip and transfers the signal per se to the chip, as well. However, as indicated by a triangle in FIG. 3, if f=953 MHz, Ra=72Ω and the imaginary part=0. However, because an extremely high value of about 1000Ω is required for the radiation resistance Ra of the RFID tag antenna, Ra must be increased. Therefore, it is well-known that a folded dipole antenna with a total length of about 145 mm, as shown in FIG. 1B, is implemented and the Ra can be increased to about 300Ω to 1500Ω, depending on line width. Aside from the dipole part 10 in FIG. 1A becoming a folded dipole part 10*a*, FIG. 1B is the same as FIG. 1A. FIG. 3 shows an example of Ra=1000Ω. Furthermore, as shown in FIG. 1C, by connecting the inductance part 12 in parallel to this folded dipole antenna, it is rotated to the left in the admittance chart and has an imaginary component ($Ba=-1/\omega La$) of an absolute value which is the same as the chip ($Bc=-\omega Cc$). The shorter the inductance length is, the smaller the La value and larger the rotation amount. In this way, the imaginary component Bc of the chip and imaginary component Ba of the antenna are the same magnitude, are cancelled, and resonate.

This imaginary component cancellation is the most important factor in RFID tag antenna design. On the other hand, although it is preferable that the resistance Rc of the chip and the radiation resistance Ra of the antenna match, it is not necessary for these to match exactly, and antenna reception power can be supplied to the chip without any problems if their ratio is about two or less.

The foregoing describes the basic design method for RFID tag antennas, and it is necessary to design the basic antenna such that Ra=1000Ω at the point where the design frequency f=953 MHz and the imaginary part=0 and an inductance ($Ba=-1/\omega La$; La=40 nH) which has the same absolute value as the susceptance ($Bc=\omega Cc$; Cc=0.7 pF) of the chip is connected in parallel.

Refer to Non-Patent Reference 1 with regards to dipole antenna.

Non-Patent Reference 1: The Institute of Electronics, Information and Communication Engineers. *Antenna Kougaku Handbook* (*Antenna Engineering Handbook*). Ohmsha, Ltd. ISBN 4-274-02677-9

However, because an antenna with a height of about 15 mm and width of about 145 mm is too large and impractical, miniaturization is necessary. For example, an antenna which has been miniaturized to about a half or a quarter of a card size (86 mm×54 mm) is more practical. However, when the antenna is miniaturized, resonance conditions do not match with the chip to be resonated therewith because the resonance frequency, which has an imaginary part=0, increases in inverse proportion to the miniaturization of the antenna if the antenna is designed by the foregoing design method.

SUMMARY OF THE INVENTION

An object of the present invention is to provide a tag antenna which can be miniaturized.

The tag antenna of the present invention composed of a dipole antenna and a feeding part with a chip mounted thereto, comprising: a dipole part of a length shorter than half of the antenna resonance wavelength; a feeding part provided in the center of the dipole part; and end parts provided with an area larger than the line width of the dipole part, on both ends of the dipole part.

A small antenna which has an antenna length smaller than λ/2 (λ being the antenna resonance wavelength) can be formed, and a communication distance which is 60 to 75% of that of a standard λ/2-length folded antenna can be maintained. In addition, the cost of the antenna can be reduced significantly by removing unnecessary metal components.

DESCRIPTION OF THE PREFERRED EMBODIMENTS

In an embodiment of the present invention, by connecting an inductor to an RFID tag antenna having an antenna length which is shorter than λ/2, λ being the antenna resonance wavelength, in parallel, the RFID tag antenna can be matched with an LSI chip by rotating the point of a frequency (desired frequency), which is lower than the antenna resonance frequency (frequency higher than the desired frequency) which has an imaginary part=0 on the admittance chart, to the left until a point matching the LSI chip. This antenna length is preferably about ⅜λ to λ/6. In addition, the antenna is preferably folded in such a way as to fold around the inside. The antenna length can be maximized within a limited area by forming the inductance in an empty space of the inside. The line width of the antenna can be in part widened and the area can be increased. In addition, an appropriate inductance length is selected, taking into consideration the specific dielectric constant and thickness of the object to be adhered. In addition, sections of the antenna part with low current density can be partially removed. A slit-shaped form of removal is preferred. In addition, the shape of the antenna part after removal is preferably a triangular or rectangular ring. It is preferable to form the antenna on a sheet (paper, film, PET) with metal, of which the main constituent is Cu, Ag, or Al.

This is under the assumption that the RFID tag antenna will be used in a UHF band. (The purpose of miniaturization is lost if the operating frequency is 2.45 GHz.)

FIG. 4 to FIG. 11 are diagrams explaining a first embodiment of the present invention.

Figure 1A:
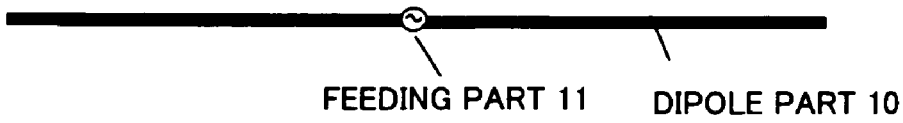
FIG. 1A PRIOR ART
FIGS. 1A to 1C are diagrams explaining a tag antenna used in a conventional RFID system.
Figure 1B:
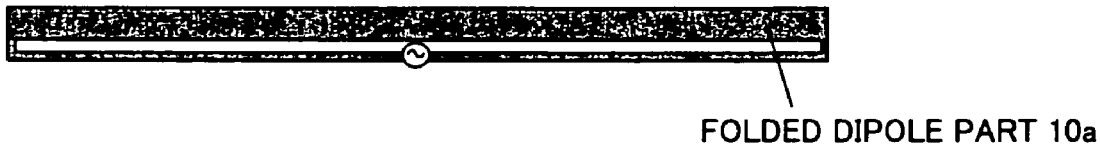
FIG. 1B PRIOR ART
Figure 1C:
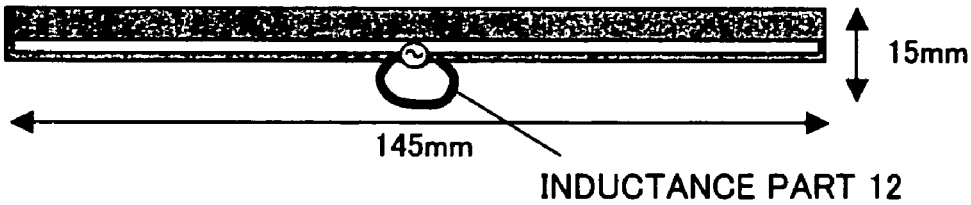
FIG. 1C PRIOR ART
Figure 2:
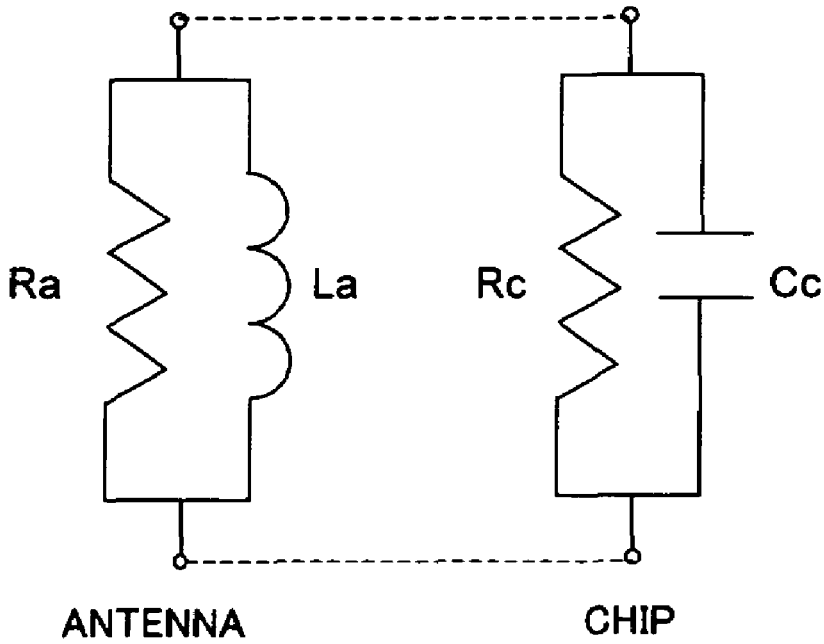
F I G. 2 PRIOR ART
FIG. 2 is a diagram showing an equivalent circuit of the RFID tag antenna.
Figure 3:
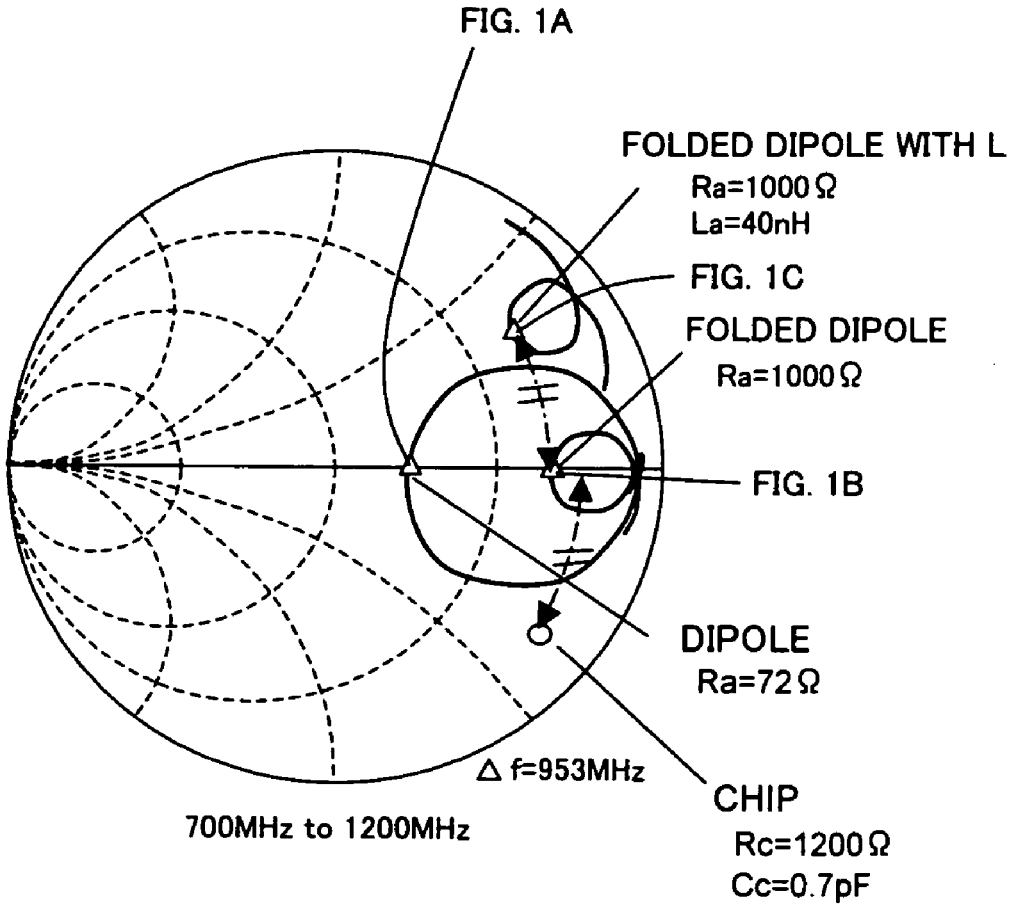
FIG. 3 PRIOR ART
FIG. 3 is a diagram showing an example of an analysis by the admittance chart of a conventional tag antenna.
Figure 4:
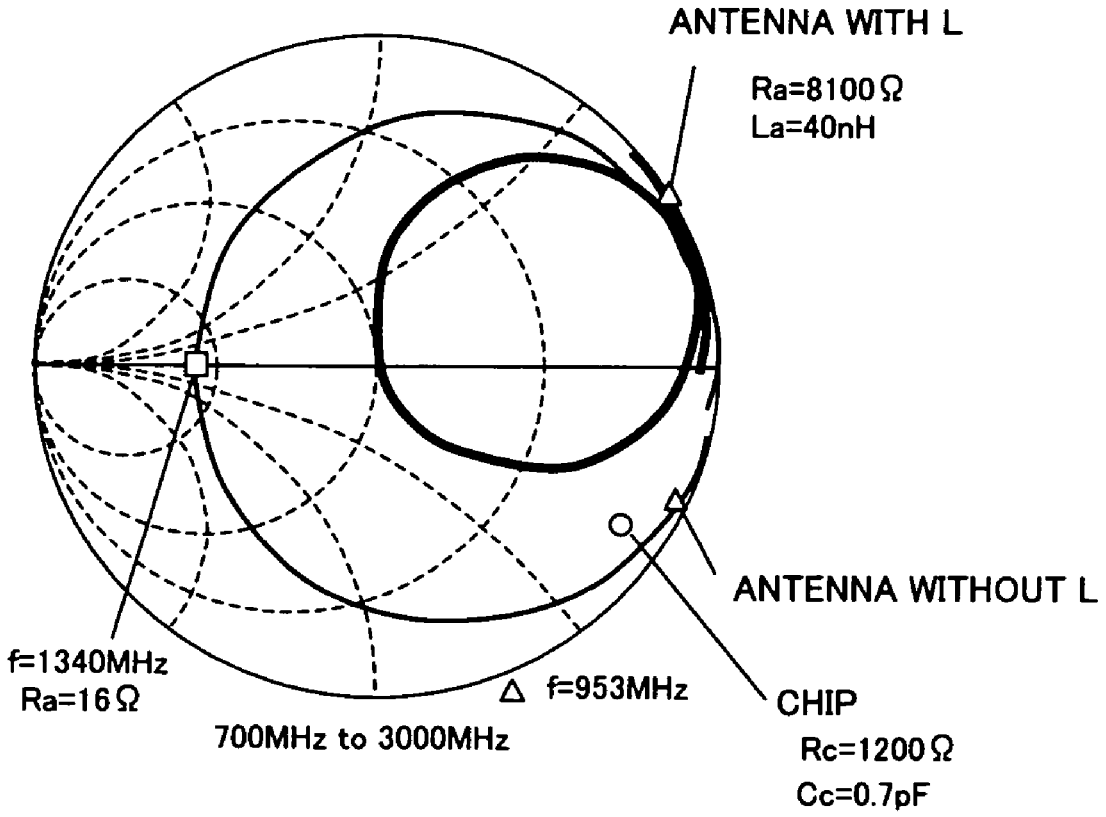
FIG. 4 is a diagram (1) explaining a first embodiment of the present invention.
Figure 6:
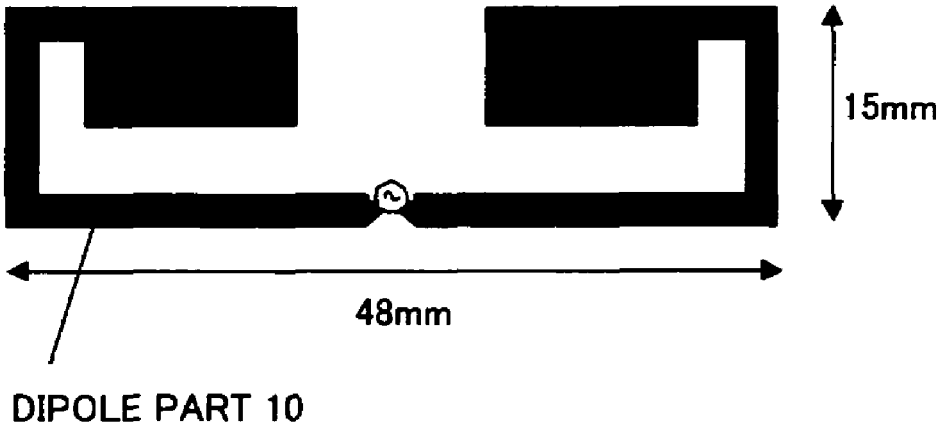
FIG. 6 is a diagram (3) explaining the first embodiment of the present invention.

As shown in FIG. 6, a dipole is formed with a height of 15 mm×width of 48 mm (effective total length, approximately 116 mm=⅜λ), under the constraint of an area smaller than ¼ of a card area. The antenna in FIG. 3 has a rolled dipole part 10. Electromagnetic field simulation is performed for this antenna configuration, and when the calculation results of f=700 MHz to 3000 MHz are plotted on an admittance chart, a trajectory (antenna without L) such as the thin line of FIG. 4 is formed. At the imaginary part=0, f=1340 MHz, which is large, and Ra=16Ω, because the RFID tag antenna is miniaturized. Generally, if the dipole is bent, the radiation resistance Ra becomes smaller than the Ra=72Ω of an ordinary straight dipole. In this case, the f=953 MHz point is in a position shown by a triangle indicated as an antenna without L in FIG. 4. Then, by connecting an inductance part (S2=30 mm) 12 to this dipole in parallel, as shown in FIG. 4, the trajectory on the admittance chart rotates to the left, as a whole. Thus, the frequency characteristics form a trajectory such as that shown by the bold line (antenna with L) in FIG. 4. At this time, when electromagnetic field simulation is preformed, the f=953 MHz point becomes Ra=8100Ω and La=40 nH. Although this point matches with regards to the imaginary part (inductance), it is considered that most of the antenna reception power rebounds into the air because the antenna radiation resistance Ra=8100Ω is too large for the Rc=1200Ω of the chip causing the fraction reflected to be large.

Figure 5:
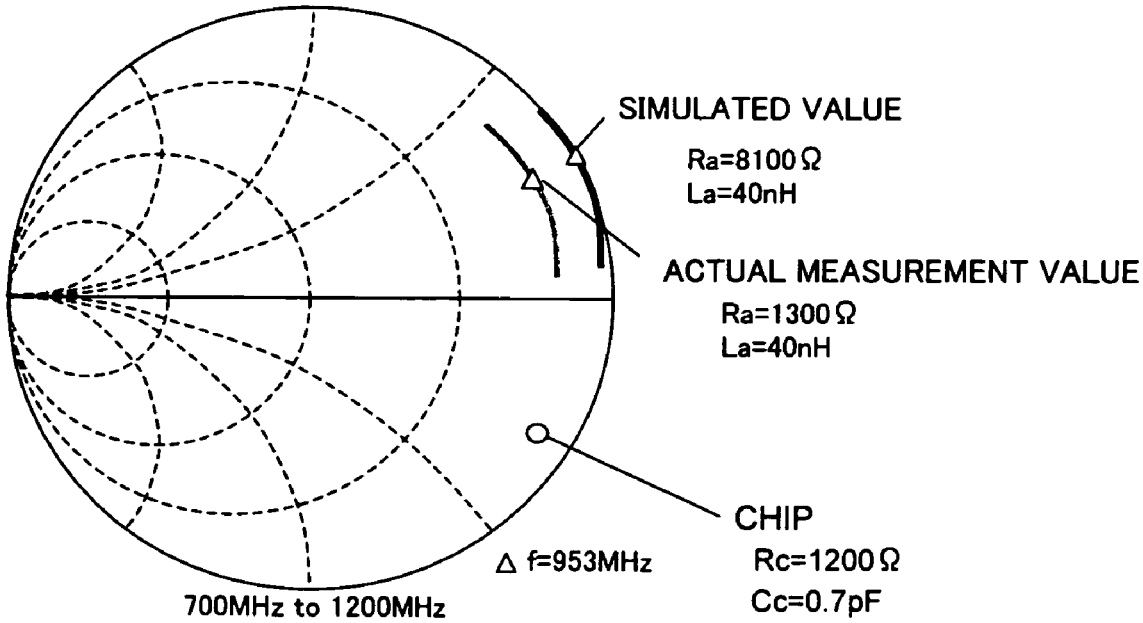
FIG. 5 is a diagram (2) explaining the first embodiment of the present invention.

However, when this antenna was produced experimentally (an antenna with a thickness of 35 μm was formed of copper) and the admittance measured, the position of the antenna with L on the admittance chart was discovered to be considerably inside, as shown in FIG. 5, because of loss in the conductor. At this time, it is recognized that the measured Ra=1300Ω and measured La=40 nH. In other words, it became clear, empirically that La basically matches with the value of the electromagnetic field simulator, and Ra becomes a value near the Rc=1200 Ω of the chip. In this way, it is known that the small antenna and chip match and the antenna reception power can be supplied sufficiently to the chip.

Here, because the antenna length ⅜λ of the antenna in the present invention is shorter than the most radiation-efficient λ/2 antenna, the radiation efficiency slightly decreases, and the electromagnetic field simulator calculation value of this antenna is gain=approx. −2.7 dBi, to the gain=approx. 2 dBi of the λ/2-long folded dipole. As a result of actually producing both antennas experimentally and comparing communication distances, a communication distance which is 60% of the λ/2 -long folded dipole was obtained. However, obtaining a communication distance of 60% from a small antenna of 48 mm×15 mm is extremely significant for practical purposes.

Figure 8:
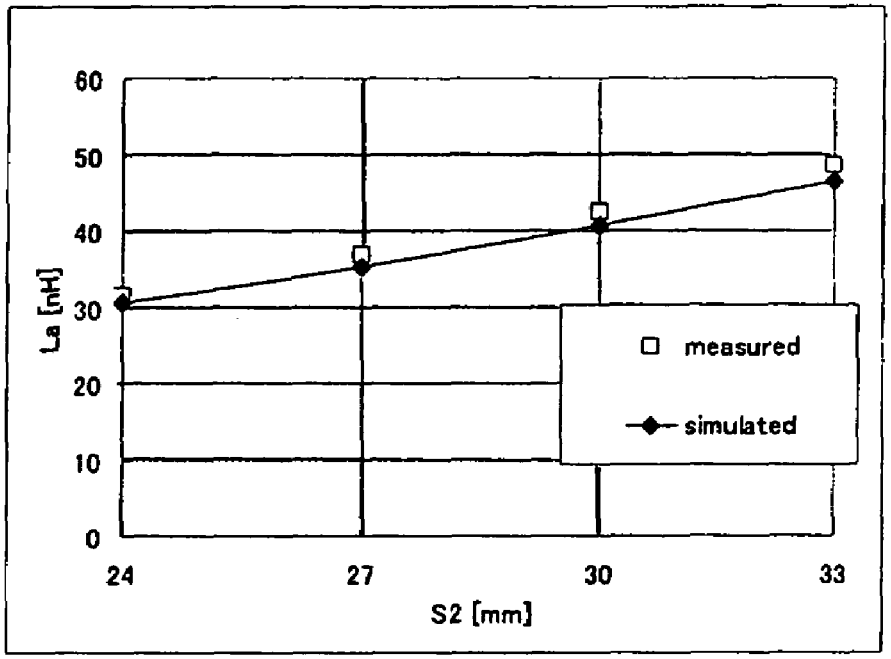
FIG. 8 is a diagram (5) explaining the first embodiment of the present invention.
Figure 9:
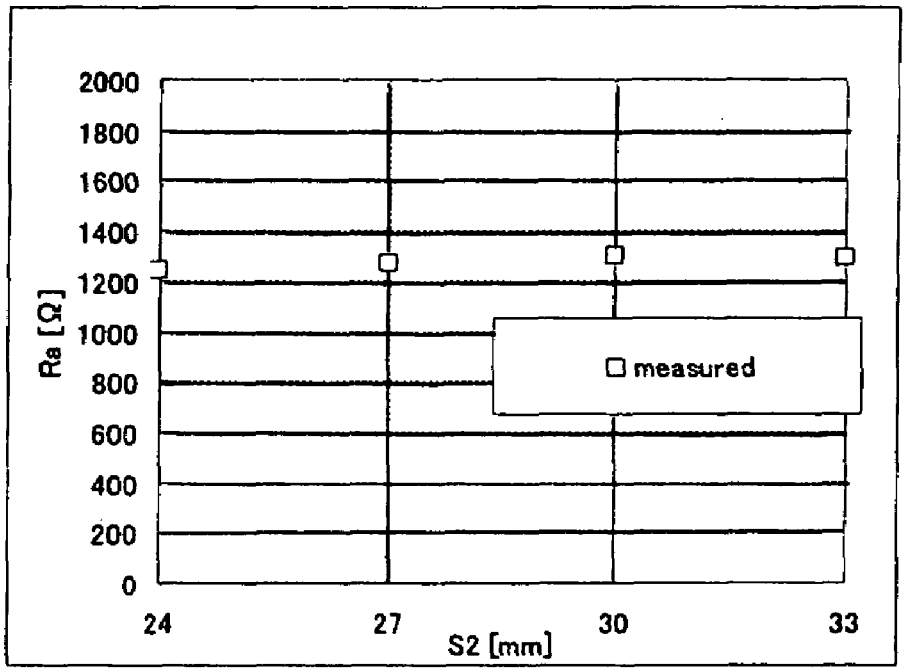
FIG. 9 is a diagram (6) explaining the first embodiment of the present invention.
Figure 10:
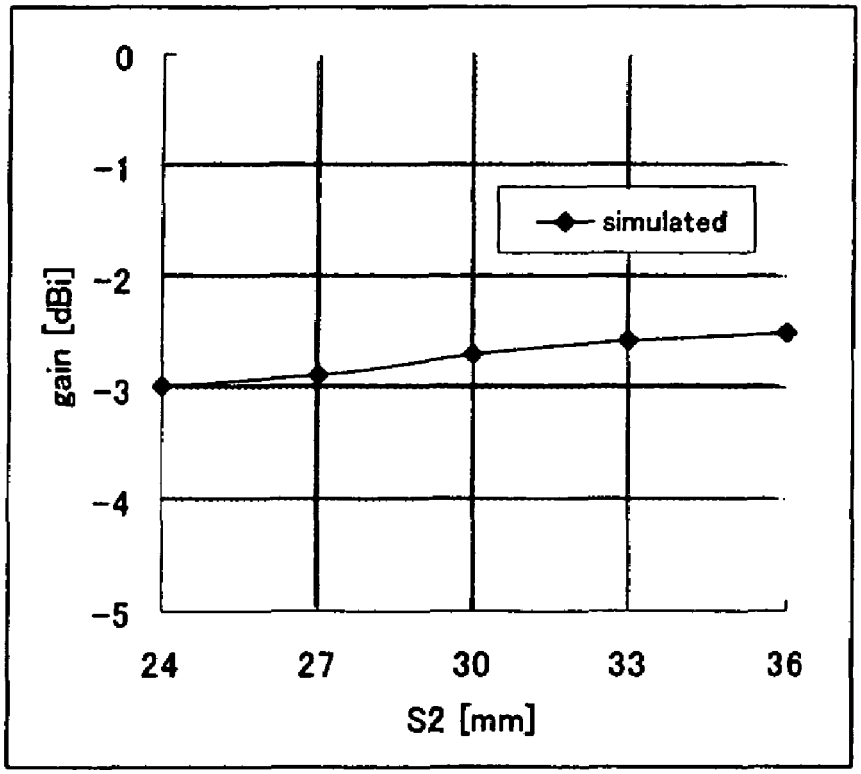
FIG. 10 is a diagram (7) explaining the first embodiment of the present invention.

If the inductance length S2 is changed from S2=24 mm to 33 mm, the actual measurement value of the La value matches well with the simulation value, as shown in FIG. 8, and the actual measurement of Ra is actually an almost constant 1200 Ω to 1300Ω, as shown in FIG. 9. In addition, it is known that the gain value is about −3 to −2.5 dBi at simulation value. Therefore, from these facts, when the Cc values differ according to the type of chip, if the S2 value is selected appropriately according to the value, an La which matches Cc can be obtained, as well as an appropriate Ra, and an antenna which has a practical gain can be manufactured.

In summary of the foregoing, an imaginary component is canceled by connecting in parallel the inductance La to a small antenna of less than λ/2 in length, and giving the length S2 of this inductance an appropriate length S2 such as to resonate according to the Cc value of the chip. On the other hand, the antenna radiation resistance Ra can match well with the chip because it is a value very close to the chip resistance Rc due to conductor loss of the antenna. It is presumed that the antenna radiation resistance Ra is too large and does not match with the chip, if determination is made only from the electromagnetic simulation result, and thus, the present antenna design method is not normally considered. However, the present manufacturing method was invented based on the empiric data obtained from numerous experimental production results. Here, it is important in the present manufacturing method that Rc of the chip is large, 1000Ω to 2000Ω. The chip used in the RFID tag is chosen to have a large resistance Rc in order to obtain the operating voltage of the chip, because drive power is also extracted from the received radiation field.

If the resistance Rc of the chip is small, it is thought that the antenna radiation resistance Ra will not assume a value which generates resonance and which matches the resistance Rc of the chip due to the conductor loss of the antenna alone.

Figure 11A:
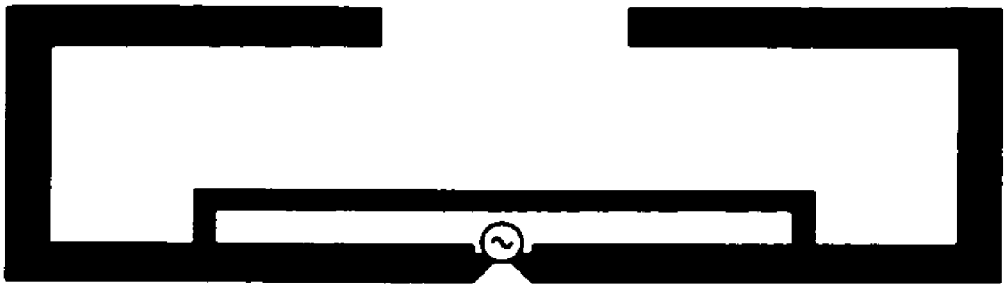
FIGS. 11A and 11B are a diagrams (8) explaining the first embodiment of the present invention.
Figure 11B:
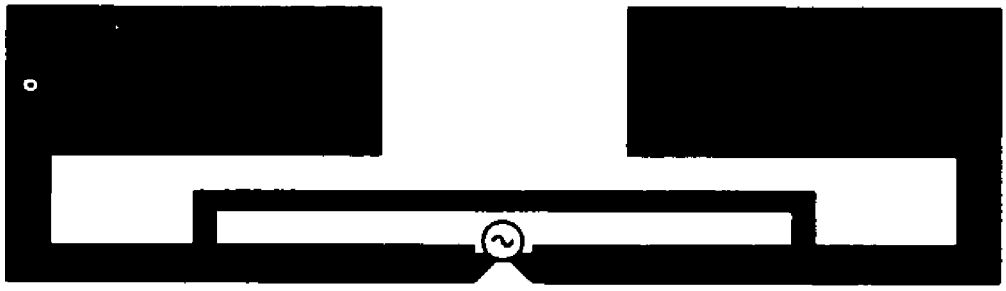

In addition, the shape of the dipole is not limited to the foregoing and a dipole shape within 15 mm in height and 48 mm in width, as shown in FIG. 11A and FIG. 11B, can be considered. However, in these cases, the gains are −3.6 dBi and −3.0 dBi, respectively, and it is clear that the antenna in FIG. 7 has a slightly higher gain.

FIG. 12A to FIG. 14 are diagrams explaining a second embodiment of the present invention.

In RFID, the tag antenna may be implemented adhered to a target object. In this case, the most suitable inductance must be selected very carefully because the resonance wavelengths change due to the specific dielectric constant (∈r) of the object to which it is adhered.

Figure 12A:
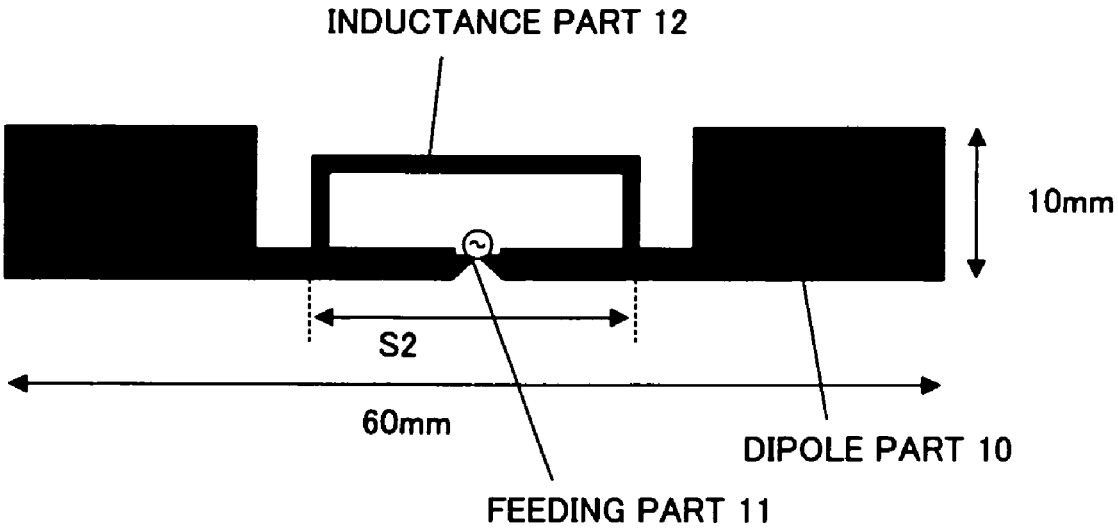
FIGS. 12A and 12B are a diagrams (1) explaining a second embodiment of the present invention.
Figure 12B:
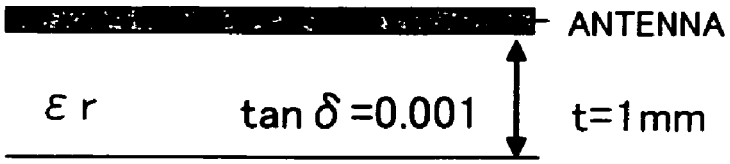

As shown in FIG. 12A, the dipole was formed with a height of 10 mm and a width of 60 mm (effective total length, approximately 75 mm=λ/4) and designed using electromagnetic simulation and experimental product measurements with the same considerations as the first embodiment. The thickness of the object to which the antenna is adhered is assumed to be t=1 mm and the specific dielectric constant to be ∈r=1, 3, or 5 (air is ∈r=1, plastic is ∈r=3 to 4, and rubber is ∈r=4 to 5). As a result, the inductance La of the antenna to the inductance length S2 is the value shown in FIG. 13. Because it is known from the first embodiment that the actual measurement and the simulation value for inductance almost match, this simulation value is reliable. In addition, from the results of the experimental production of the antenna, the antenna radiation resistance is Ra=1270Ω regardless of the S2 value. In addition, the simulation value of the gain is the value shown in FIG. 14. Here, the larger ∈r is, the larger the gain is, because the larger ∈r is, the shorter the wavelength becomes, and the antenna length seen from the shortened wavelength looks longer and is closer to the length of λ/2, which has high radiation-efficiency. However, the calculation here is made under the assumption that the dielectric loss of the dielectric constant is Tanδ=0.001, and therefore, the dielectric constant has almost no influence on antenna gain. However if the dielectric loss is great, the gain may fall.

Figure 13:
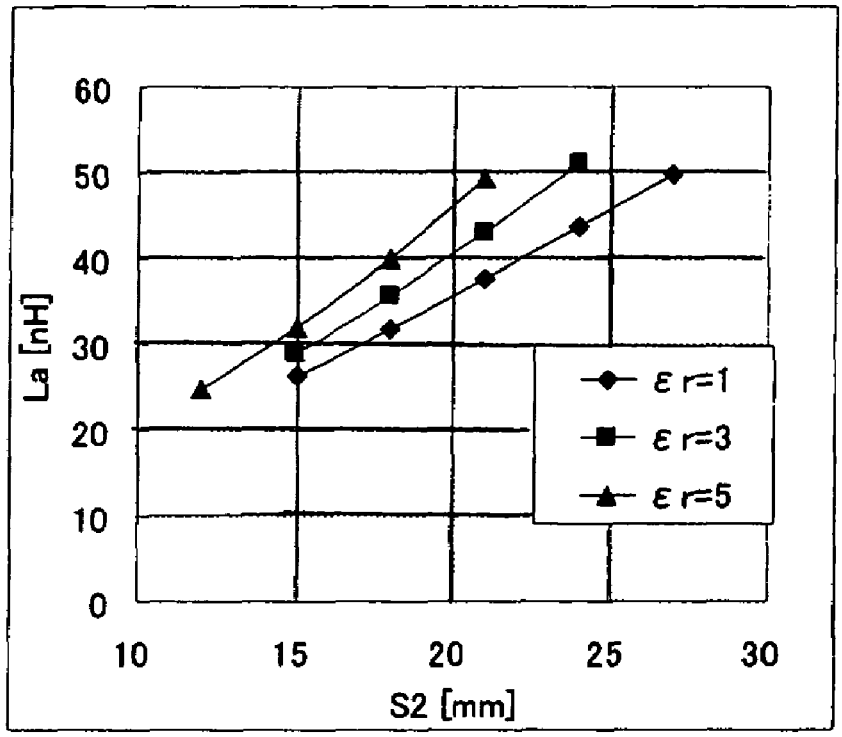
FIG. 13 is a diagram (2) explaining the second embodiment of the present invention.
Figure 14:
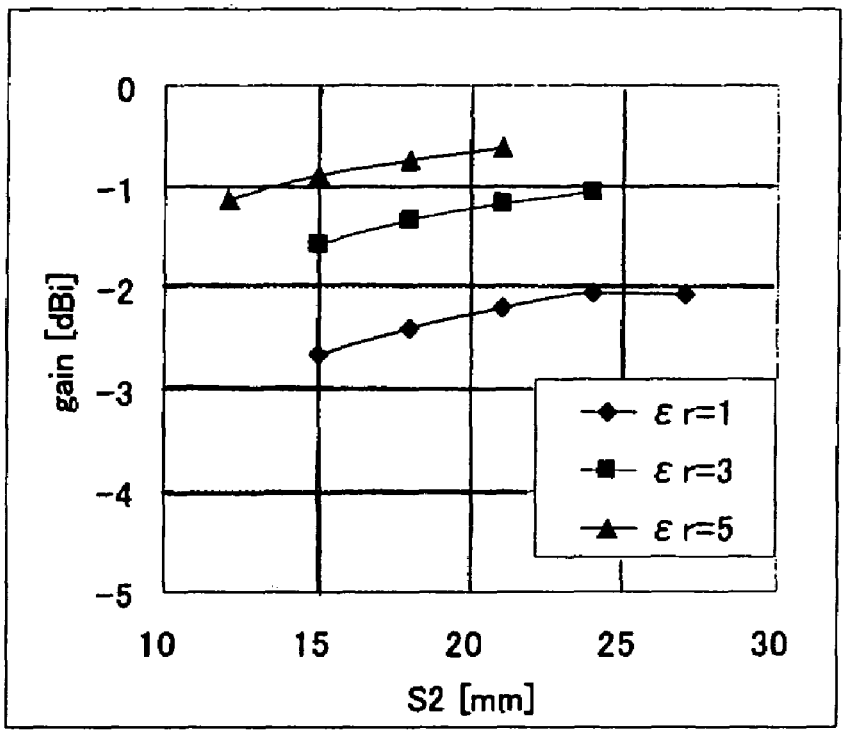
FIG. 14 is a diagram (3) explaining the second embodiment of the present invention.

In order for the inductance value La of the antenna to become 40 nH which matches with a Cc=0.7 pF chip from FIG. 13, S2=22 mm is selected from a curve of ∈r=1 if the antenna is used alone, or in other words, when the antenna is not adhered anywhere. If the antenna is adhered to an object with a thickness of 1 mm and ∈r=3, S2=20 mm should be selected, and if the antenna is adhered to an object with a thickness of 1 mm and ∈r=5, S2=18 mm.

As a result of actually experimentally producing an antenna with S2=20 mm, adhering it to a plastic object with a thickness of 1 mm, and measuring the communication distance, a communication distance which is 65% of the λ/2 folded dipole is obtained. Although the communication distance has become shorter, a communication distance of 65% from a small antenna of 10 mm×60 mm is extremely practical.

Although an instance wherein one surface of the antenna is adhered is assumed in the present invention, for example, the antenna is coated in resin or the like, dielectric materials exist on both surfaces of the antenna, and therefore, antenna design by the same method is possible if La value versus S2 value data is obtained by an electromagnetic simulator under the assumption that there are dielectric materials on both surfaces of the antenna, as in the present embodiment. In addition, although the thickness is assumed to be 1 mm, even if the thickness is thicked than that assumed, it is enough to perform calculation using the electromagnetic simulator by considering the thickness.

Figure 7:
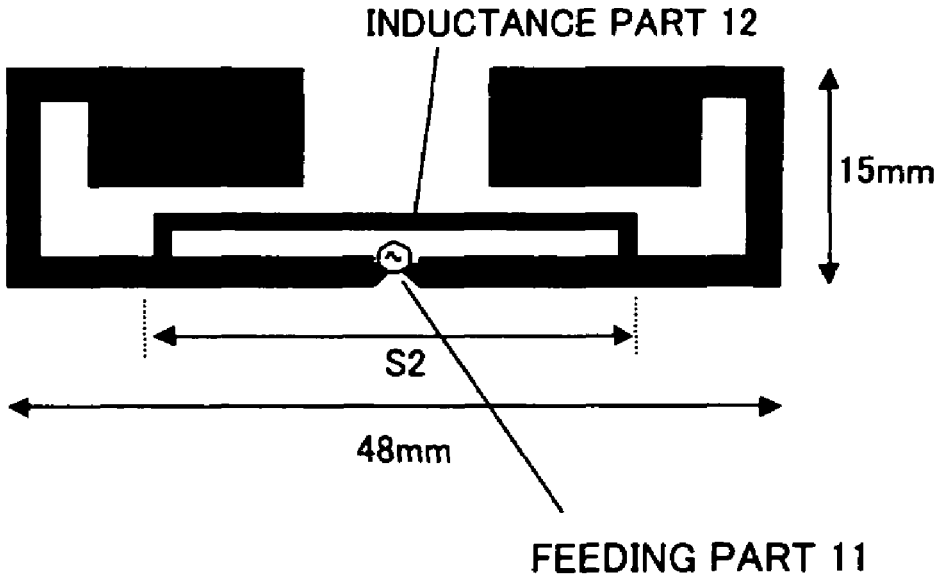
FIG. 7 is a diagram (4) explaining the first embodiment of the present invention.

In addition, the shape of the antenna used in the present embodiment can be shaped like the antenna of the first embodiment, shown in FIG. 7 and FIG. 11.

FIG. 15 to FIG. 21 are diagrams explaining a third embodiment of the present invention.

Figure 15:
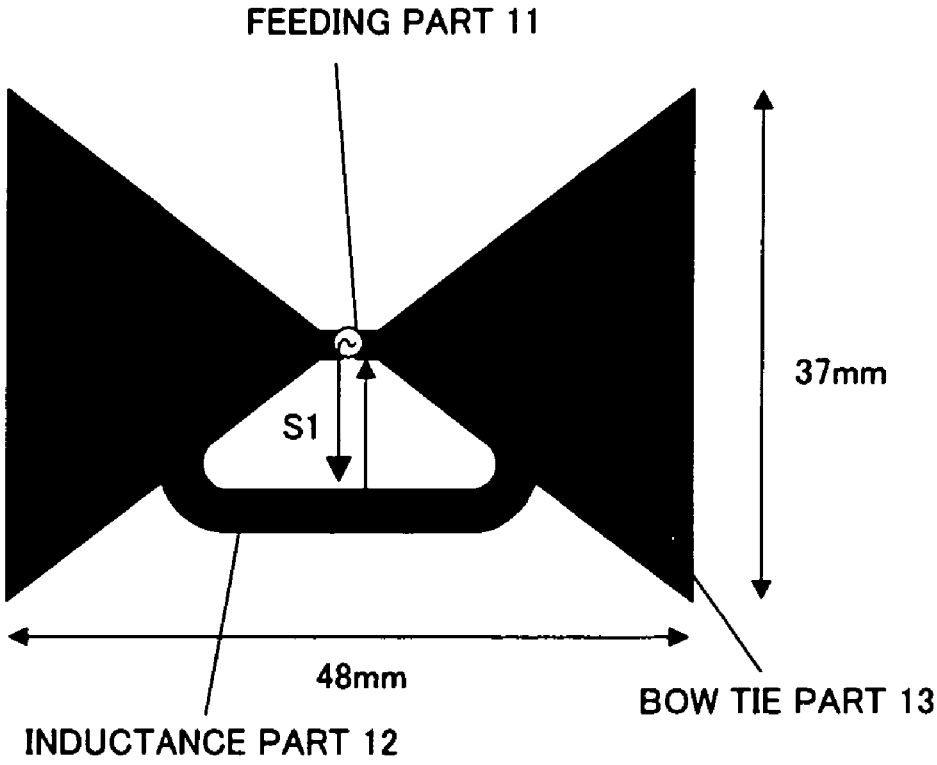
FIG. 15 is a diagram (1) explaining a third embodiment of the present invention.

As shown in FIG. 15, under the assumption that the size is half of a card size, a bow-tie-shaped dipole (Bow Tie part 13) was formed with a height of 37 mm and a width of 48 mm (effective total length, approximately 110 mm=⅜λ) and designed using electromagnetic simulation and experimental product measurements with the same considerations as the first embodiment. As a result, the La value became that shown in FIG. 16 as a function of the inductance length S1. Because it is known from the first embodiment that the actual measurement and the simulation value for inductance almost match, this simulation value is reliable. In addition, from the results of the experimental production of the antenna, the antenna radiation resistance is Ra=1150Ω regardless of the S1 value. Further, the simulation value of the gain is the value shown in FIG. 14. Because the area of the dipole part is larger than that of the antennas shown in the first and second embodiments, gain is increased.

Figure 16:
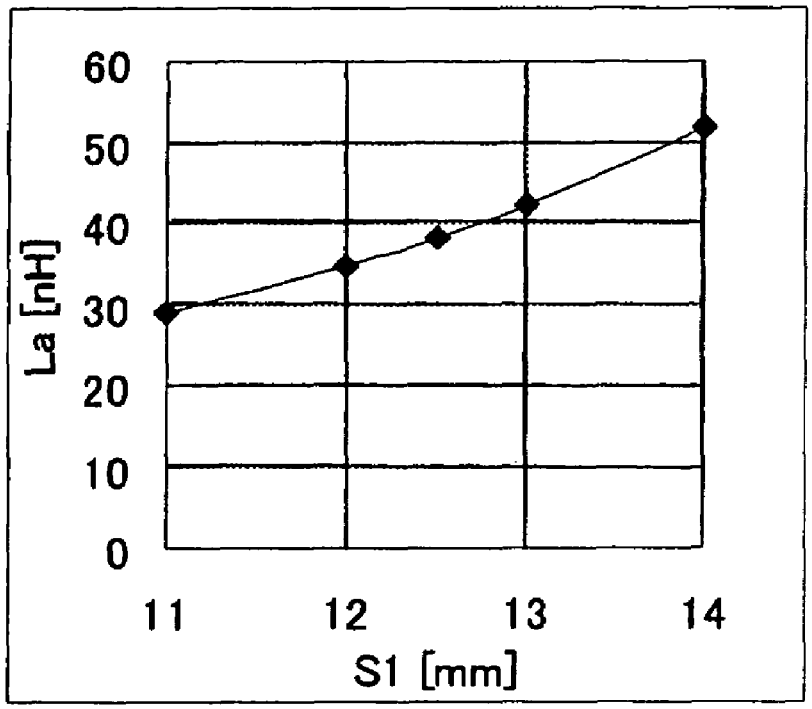
FIG. 16 is a diagram (2) explaining the third embodiment of the present invention.
Figure 17:
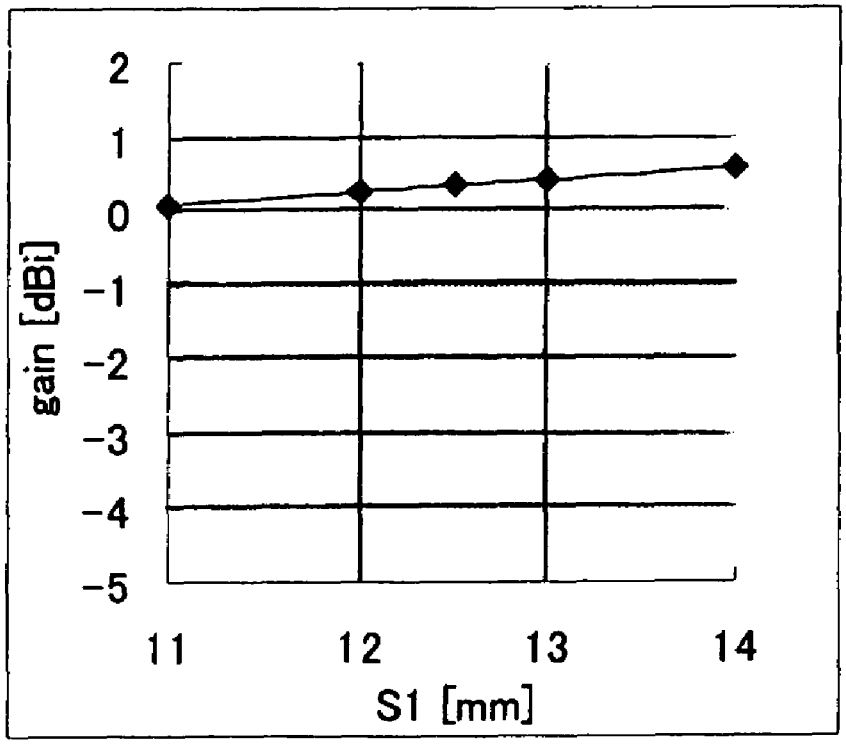
FIG. 17 is a diagram (3) explaining the third embodiment of the present invention.

In order for La=40 nH to be realized, S1=12.7 mmis selected from FIG. 16.

As a result of actually experimentally producing an antenna with S1=12.7 mm and measuring the communication distance, a communication distance which is 75% of the λ/2 folded dipole is obtained. Although the communication distance is reduced, a communication distance of 75% from a small antenna of 37 mm×48 mm is extremely practical.

Figure 18:
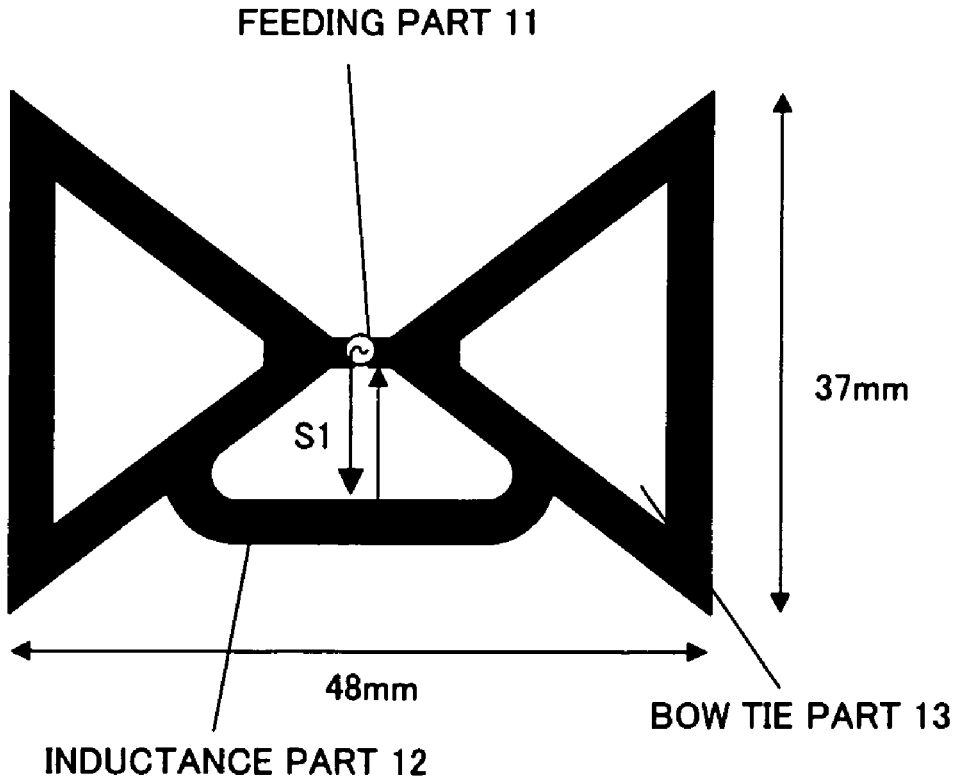
FIG. 18 is a diagram (4) explaining the third embodiment of the present invention.
Figure 19:
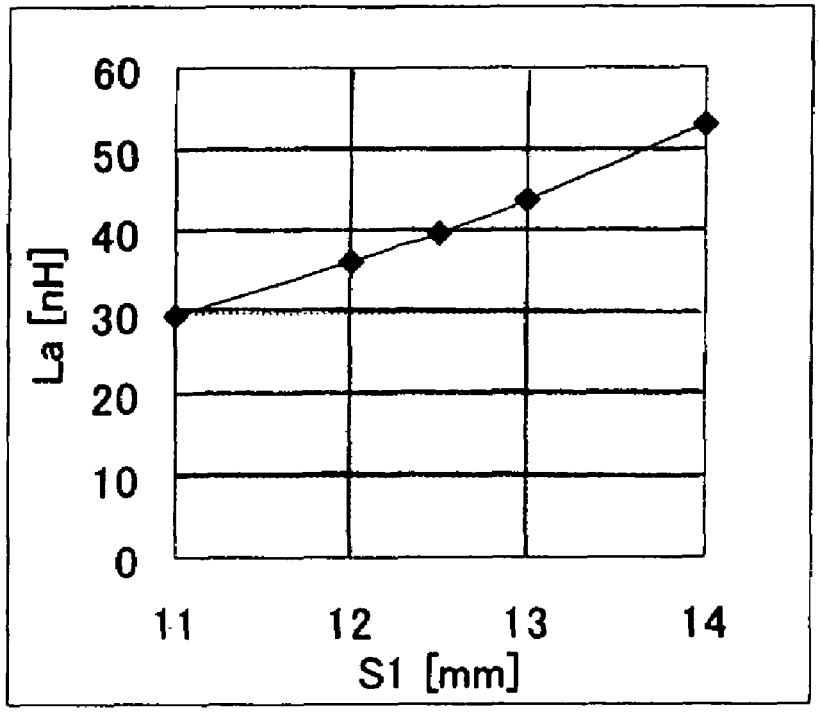
FIG. 19 is a diagram (5) explaining the third embodiment of the present invention.
Figure 20:
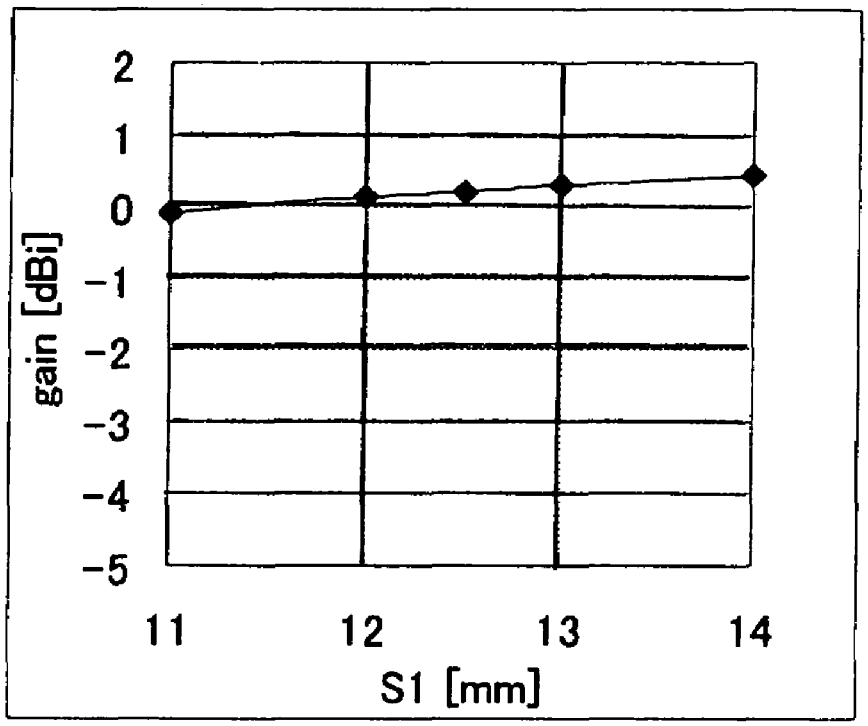
FIG. 20 is a diagram (6) explaining the third embodiment of the present invention.

Here, there is a method for printing on a film or the like with conductive ink, to which an Ag paste is combined, when forming an antenna. In this case, if the amount of Ag paste is large, the cost of one antenna becomes high. Thus, forming the antenna by cutting out a section of the antenna to which little current flows, as shown by FIG. 18, is considered. The Bow Tie part 13 is cut out in FIG. 18. Generally, because high-frequency current is concentrated at the edge parts of the conductor, antenna characteristics are affected little even if the metal near the center is cut away when the metal area is large. In particular, this is extremely effective with a Bow Tie-shaped antenna such as this, which has a large metal area. As in the foregoing, the La value and gain are determined, as shown in FIG. 19 and FIG. 20. Because sufficient amounts of the metal parts of the inductor remain, an La value of almost the same value as the antenna in FIG. 15, before being cut into triangles can be obtained. The gain value is not a problem because it only decreases by about 0.2 dB. By this triangular cutting, the area of the metal section is reduced from 920 [$mm^2$] to 540 [$mm^2$], and antenna characteristics almost the same to those of the original can be maintained, even if the amount of conductive ink is reduced significantly.

As a result of actually experimentally producing an antenna with S2=12.5 mm and measuring the communication distance, a communication distance which is 70% of the λ/2 folded dipole is obtained. Although the communication distance is reduced, a communication distance of 70% from a small antenna of 37 mm×48 mm is extremely practical.

Figure 21:
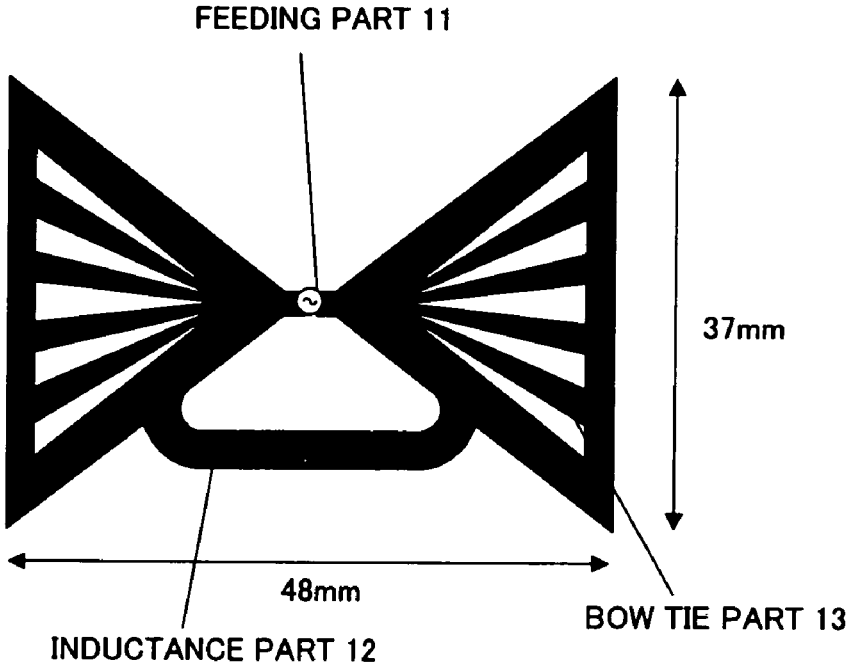
FIG. 21 is a diagram (7) explaining the third embodiment of the present invention.

In addition, although the metal section is cut into triangular rings in the present embodiment, it can be cut into slits, as in FIG. 21. In FIG. 21, a method wherein gain is secured by cutting the Bow Tie part 13 into slits is used, rather than completely removing sections.

Furthermore, the method for removing sections to which current is not concentrated is also effective for antennas such as those in FIG. 7 and FIG. 12A. In addition, beyond antennas shaped such as those shown in the present embodiment, methods for removing sections to which current is not concentrated are extremely effective.

In a manufacturing method wherein conductive ink is printed onto a film, an antenna is formed on a sheet (paper, film, or PET) with metal, of which the main constituent is Cu, Ag, or Al. Refer to U.S. Pat. No. 6,259,408, with regards to details of the manufacturing method.

What is claimed is:

1. A tag antenna composed of a dipole antenna and a feeding part with an RFID chip mounted thereto and connected to the feeding part, comprising:

the dipole part of an electrical length of about ⅙ to ⅜ of an antenna resonance wavelength;

the feeding part provided in the center of said dipole part, wherein the dipole part comprises a first portion connected to the feeding part, second portions connected to and perpendicular to the first portion, and end parts connected to the second portions;

an inductance part formed such as to surround said feeding part with said feeding part in the center and such that both ends are connected to said first portion of said dipole part, wherein the inductance part has a length shorter than a length of the first portion of the dipole part and so as to satisfy a resonance condition with a capacitance of the connected RFID chip, wherein the inductance part is arranged between the end parts and the dipole part;

the end parts provided with an area larger than a line width of said dipole part, on both ends of the dipole antenna; and wherein the tag antenna uses a radio signal in an UHF band.

2. The tag antenna according to claim 1, wherein:

both ends of said dipole part are folded.

3. The tag antenna according to claim 1, wherein:

both ends of said dipole part are folded to become closer to each other.

4. The tag antenna according to claim 1, wherein:

said dipole part is shaped like the wings of a butterfly.

5. The tag antenna according to claim 1, wherein:

said dipole antenna and said inductance part are formed through the same procedure as printing, using a liquid including metal, of which the main constituent is copper, silver, or aluminum, on a sheet composed of paper, film, or PET.

* * * * *